United States Patent [19]

Treleven

[11] 4,015,340

[45] Apr. 5, 1977

[54] ULTRAVIOLET DRYING APPARATUS

[75] Inventor: Robert E. Treleven, Green Bay, Wis.

[73] Assignee: TEC Systems, Inc., DePere, Wis.

[22] Filed: Aug. 20, 1975

[21] Appl. No.: 606,295

[52] U.S. Cl. ..... 34/4; 34/1; 34/41; 219/348; 250/504

[51] Int. Cl.[2] ..... F26B 3/28

[58] Field of Search ..... 34/1, 4, 39, 41, 151, 34/152, 155; 219/388, 348, 354, 388 C; 432/50, 55, 42–46; 250/504, 452, 454, 503, 514, 215, 223

[56] References Cited

UNITED STATES PATENTS

| | | | |
|---|---|---|---|
| 3,733,709 | 5/1973 | Bassemir | 34/4 |
| 3,829,982 | 8/1974 | Pray et al. | 34/4 |
| 3,935,647 | 2/1976 | Aschberger | 34/105 |

*Primary Examiner*—Kenneth W. Sprague
*Assistant Examiner*—James C. Yeung
*Attorney, Agent, or Firm*—James E. Nilles

[57] ABSTRACT

Ultraviolet radiating means for curing and drying non-solvent ink which has been applied to a substrate during a printing or coating process, the radiating means including a plurality of elongated parallel ultraviolet lamp assemblies mounted to radiate against the non-solvent ink as the substrates are passed in front of the lamp assemblies. The lamp assemblies are slideably mounted in side by side relation in a module which is in turn slideably received in a housing. The lamp assemblies each include an ultraviolet lamp mounted in a elongated reflector shaped to reflect the ultraviolet radiation emitted from the lamp and to focus it to form a narrow band. The lamp assemblies are mounted in the housing so as to be freely rotatable from a curing position to a position where they are directed toward a heat exchanger. The lamp assemblies may also be mounted so that a pair of the lamps will direct ultraviolet radiation at the same area on the substrate. The housing is also provided with means for forcing air therethrough for cooling the lamp assemblies to prevent overheating.

16 Claims, 18 Drawing Figures

FIG. 13
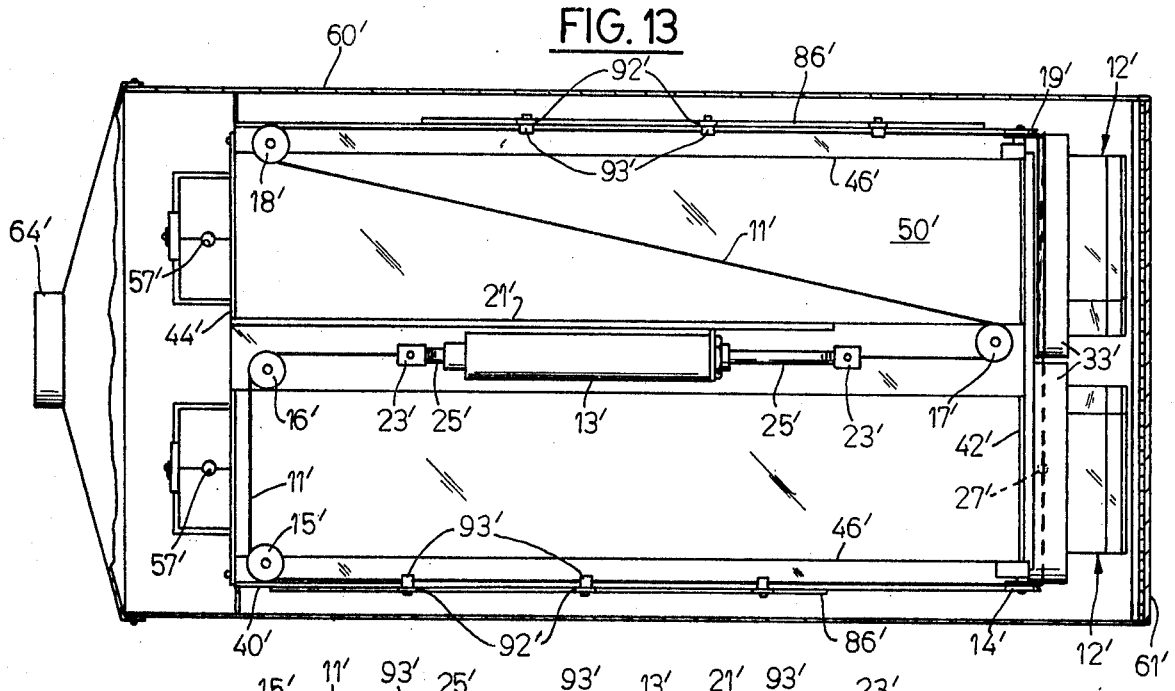
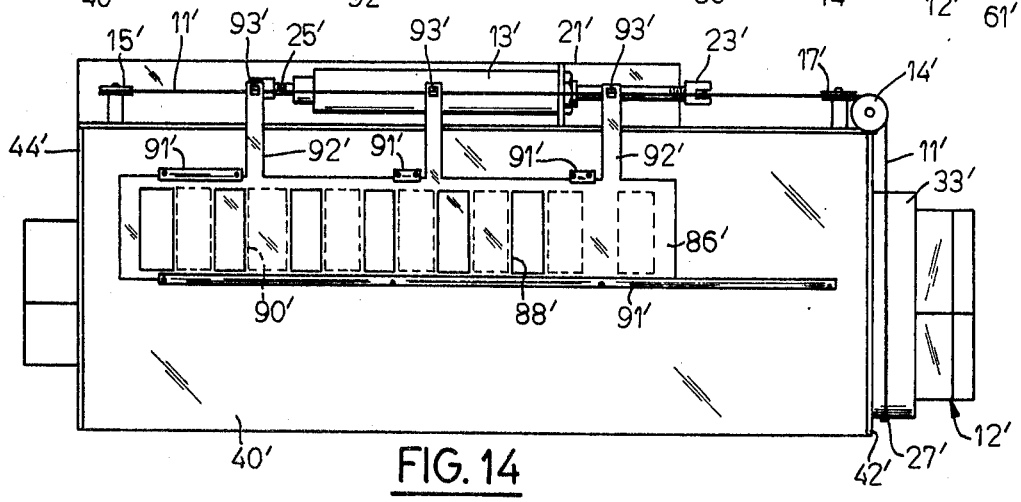
FIG. 14
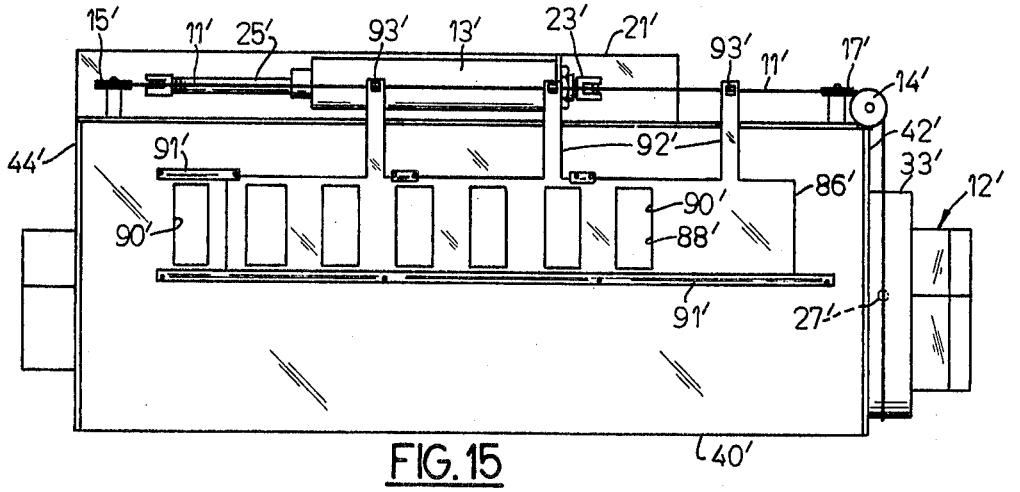
FIG. 15

ULTRAVIOLET DRYING APPARATUS

BACKGROUND OF THE INVENTION

The present invention is related to ultraviolet radiating apparatus which are used to cure solvent-free ink which has been applied to a substrate by printing or coating. More particularly, the invention is directed to improvements in apparatus of the type generally shown by U.S. Pat. No. 3,733,709 issued May 22, 1973 to Bassemir et al. and U.S. Pat. No. 3,829,982 issued to Pray et al. on Aug. 20, 1974.

The prior art apparatus cited is directed to means for radiating ultraviolet (UV) light against non-solvent inks or coatings which have been applied to the surface of a substrate. The substrate may be comprised, for example, of material such as paper, fabric or thin metal sheets in continuous lengths which can receive the non-solvent ink and which can then be continuously passed beneath UV radiation means comprising a plurality of parallel elongated lamps which extend transversly to the direction of movement of the printed substrate. The ultraviolet light causes a reaction in the ink which permits it to cure. Use of such non-solvent inks has been found to be very useful in that they avoid the problems of air pollution caused by evaporating solvents used in traditional inks.

The use of non-solvent inks and UV lamps have, however, presented drawbacks which have heretofore been unsolved. It is often desirable during the printing process to halt the progression of the substrate thereby subjecting a portion of it to the radiation of the UV lamps for an extended period of time, but the UV lamps generate substantial quantities of heat which may rapidly damage or destroy the substrate if it is not continuously moved past the lamps. It is not feasible to merely shut-off the lamps because they generally require at least 5 to 10 minutes to be restarted if the power is decreased by more than 50%. None of the prior apparatus have presented an effective, uncomplicated method of protecting the substrate against continued radiation in the event it is temporarily halted.

The prior art apparatus also fails to present means to permit high speed printing and curing of the non-solvent ink. The lamps used to produce the UV radiation emit light varying from zero to a maximum value at a frequency of 120Hz and generally include a reflector which focuses the light emitted onto an area of the substrate comprising a strip approximately ½ inch wide. Therefore, if the ink is passed through the band of radiation at a high rate of speed the intensity of UV light contacting various areas of the ink will vary and the amount of curing will also vary.

SUMMARY OF THE INVENTION

The present invention is directed to an improved means for curing non-solvent inks using ultraviolet light emitting lamps. The invention includes an improved and uncomplicated but effective means for simultaneously interrupting the radiation directed at the substrate so that it can be halted without being damaged. The invention also provides means for supporting each of the UV lamps so that they are easily assembled or disassembled to permit the lamps and reflectors to be replaced or cleaned. The invention further includes means for focusing a plurality of lamps to form a single band of light for contacting the surface of the substrate to increase the effectiveness of the lamps in curing the non-solvent ink and to maintain a constant intensity despite cyclical operation of the lamps.

More specifically, the apparatus of the invention includes a module for slideably receiving the UV lamps and heat exchange units therein and a housing for receiving the module. The lamps and module are supported such that they can be easily removed to permit the lamps to be replaced or the lamps and reflectors to be cleaned. It is highly desirable that the lamps be relatively easy to replace since their life is on the order of 1000 hours. It is also desirable that the lamps and reflectors be relatively easy to clean because when the substrate is fed through the curing and drying apparatus at higher speeds the ink tends to "mist" leaving a coating on the lamps and reflectors. Such a coating can decrease the efficiency of the lamps if they are not regularly cleaned. A further advantage of the invention is that the lamp assemblies and heat exchange units which are received in the module are relatively free to expand in response to the heat generated by the lamps and therefore the heat does not result in distortion of the assembled pieces.

BRIEF DESCRIPTION OF THE DRAWINGS

FIG. 13 is a plan view of the present invention taken along the line 13—13 in FIG. 11 but on a smaller scale.

FIG. 14 is a cross-sectional view taken along the line 14—14 in FIG. 11 but on a smaller scale.

FIG. 15 is a cross-section view taken along the line 15—15 in FIG. 12 but on a smaller scale.

DESCRIPTION OF THE PREFERRED EMBODIMENTS

Figure 1:
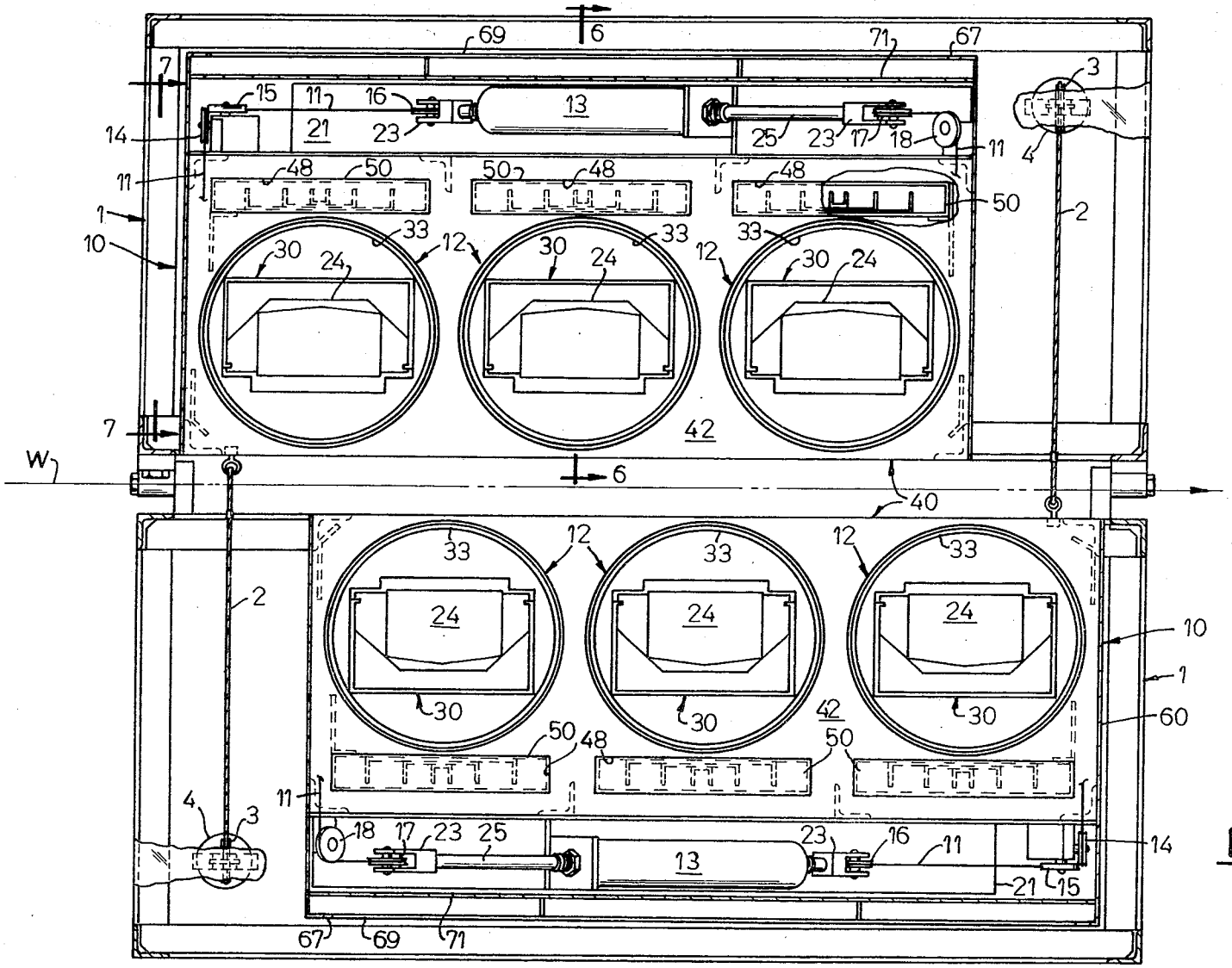
FIG. 1 is a cross-sectional elevation view of a pair of vertically opposed ultraviolet radiation means of the present invention each mounted within a supporting frame.
Figure 2:
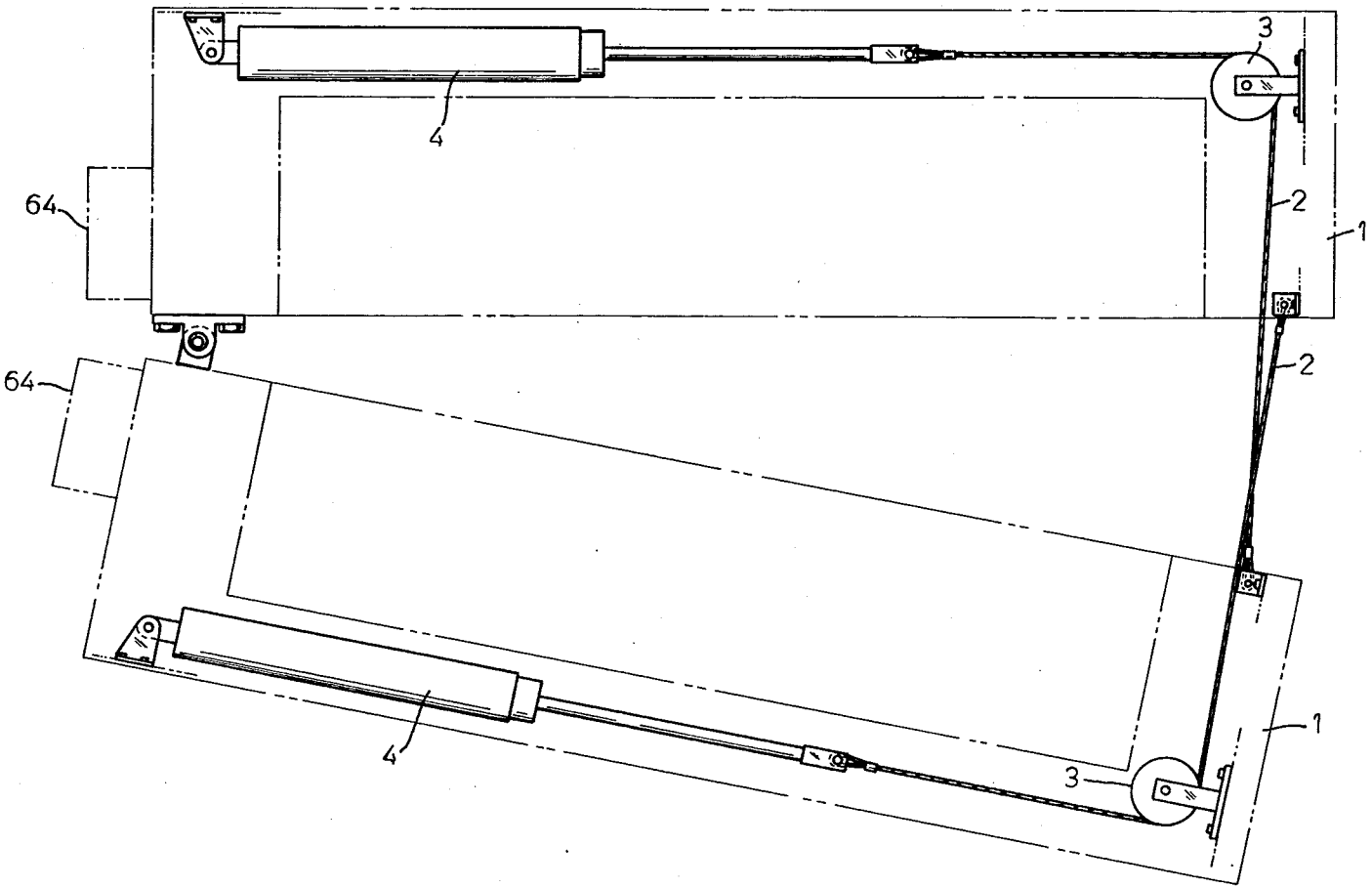
FIG. 2 is a schematic side view of the supporting frames shown in FIG. 1 but shown in a separated position.

FIGS. 1 and 2 illustrate an embodiment of the invention whereby a pair of ultraviolet radiating assemblies 10 are each secured within a supporting frame 1 and are positioned on opposite sides of a substrate for curing non-solvent based ink or non-solvent based coatings which have been applied to both sides of the substrate. The substrate supporting the non-solvent ink can comprise a variety of materials including, by way of example, webs of paper, fabric, thin metal sheet etc. For convenience, however, the substrates will be referred to herein as web W. The web W receives the non-solvent ink or coatings in a known manner and is then continuously conducted between the ultraviolet radiating assemblies 10 of the invention. As the web W is passed between the radiating assemblies 10 they each radiate ultraviolet radiation against one side of the web causing the ink thereon to cure. Generally, the radiating assemblies 10 each include three elongated cylindrical ultraviolet lamp assemblies 12 positioned in parallel relation for curing the ink on the webs and supported in a lamp module 40 which is in turn supported in a housing 60. A greater or lesser number of such lamps assemblies 12 can be used depending on the amount of radiation necessary for curing the ink and the speed with which the web W is passed between the radiating means 10. For example, if the web is printed and conducted at a high rate of speed it may be necessary to provide a fourth lamp assembly 12 or provide a pair of such radiating means 10 in parallel relation in order that the non-solvent ink on the webs W is subjected to a sufficient amount of UV radiation for a sufficient length of time that it may be cured. Of course the apparatus of the invention could be modified by removing one of the radiating means 10 entirely if the web W was to receive ink on only one of the surfaces.

The embodiment of the invention shown in FIGS. 1 and 2 illustrates the use of two supporting frames 1, each housing a UV radiating assembly 10, such that one of the assemblies 10 is mounted above the web W and a second is mounted below the web. The supporting frames are connected in a clam shell fashion by a pair of hinges H and by a pair of support cables 2. Each of the support cables 2 is secured at one end to the supporting frame 1 and is received around a sheave 3 and attached to the end of a fluid actuated piston 4 at its other end. Reciprocation of the fluid actuated piston 4 can thus cause hinged opening and closing movement of the two supporting frames 1. Such movement readily facilitates feeding of a web W between the radiating means 10 at the beginning of the operation of the apparatus and cleaning of the assemblies.

Figure 3:
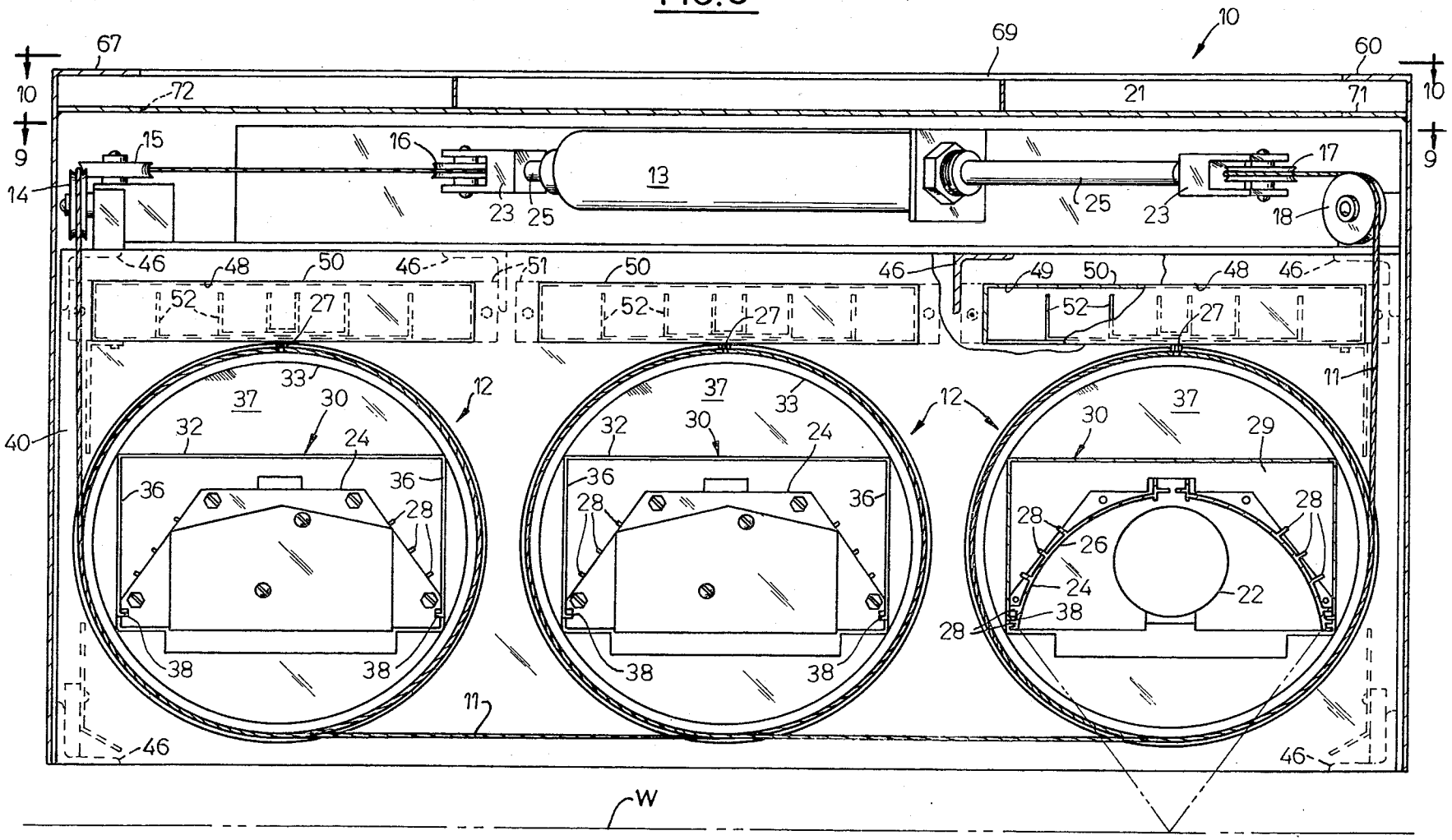
FIG. 3 is an enlarged view of the upper radiation assembly shown in FIG. 1 but partially broken away in the interest of clarity.

As previously stated, each of the UV radiating assemblies 10 includes a plurality of elongated UV lamp assemblies 12 which are received within a module 40 in parallel relation. FIG. 3 illustrates the position of the lamp assemblies when they are directed at a web W. The lamp assemblies 12 each include a lamp 22 which is surrounded by a reflector 24 and further include a reflector carrier 30 which supports the lamp and reflector in a manner to be described later. The lamp assemblies 12 are mounted in the modules 40 in a manner which permits the assemblies to be freely rotatable about their respective axis, and they are connected in series relation by a cable 11 which is wound around the end of each of the assemblies and operatively connected to a fluid actuated cylinder 13. The cable 11 is secured to each of the lamp assemblies 12 such that actuation of cylinder 13 will cause simultaneous rotation of the assemblies 12 from a position wherein they are directed at the web W as shown in FIG. 3 to a position wherein they are directed at a heat exchanger 50 as shown in FIG. 4.

Figure 9:
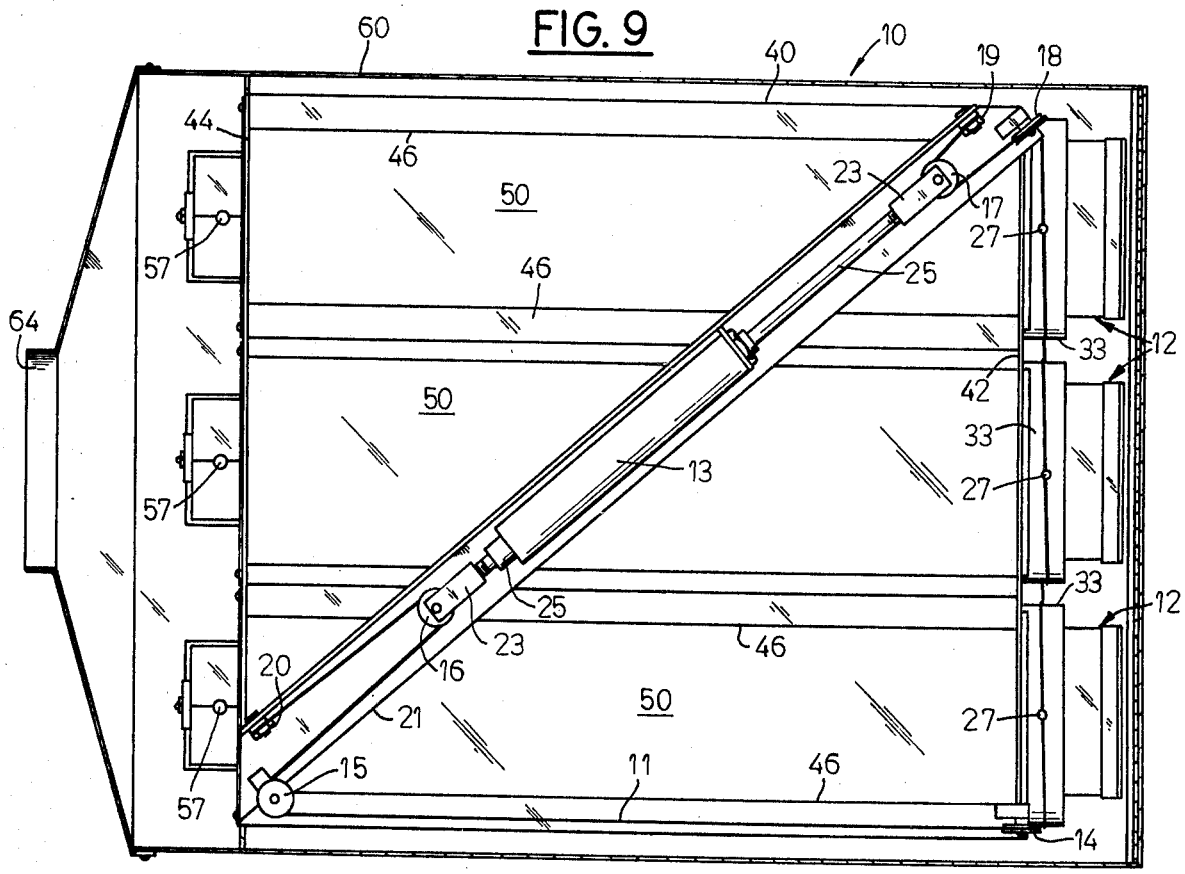
FIG. 9 is a cross-sectional plan view taken along line 9—9 in FIG. 3.

The means by which the cables 11 are connected to the cylinder 13 and wound around the circular ends of the lamp assemblies 12 is best shown in FIG. 9. The cable 11 is wound around each of the three assemblies 12 in a series relation and is secured to the assemblies by screws 27. Movement of the cable thus causes rotation of all three of the assemblies simultaneously. The cable is received around a plurality of freely rotatable sheaves 14–18 and is secured by nuts 19 and 20 to a support angle 21 which extends diagonally across the top surface of the module 40 and is secured thereto. The sheaves 16 and 17 are mounted by clevises 23 to opposite ends of piston rod 25 of the cylinder 13. The arrangement of the sheaves 14–18 is such that actuation of the rod 25 of cylinder 13 causes simultaneous rotation of the lamp assemblies 12. The length of the stroke of the rod 25 can be adjusted such that the lamp assemblies can be rotated exactly 180° from a position wherein they direct radiation at the web W to a position wherein they direct radiation at the heat exchangers 50.

Figure 5:
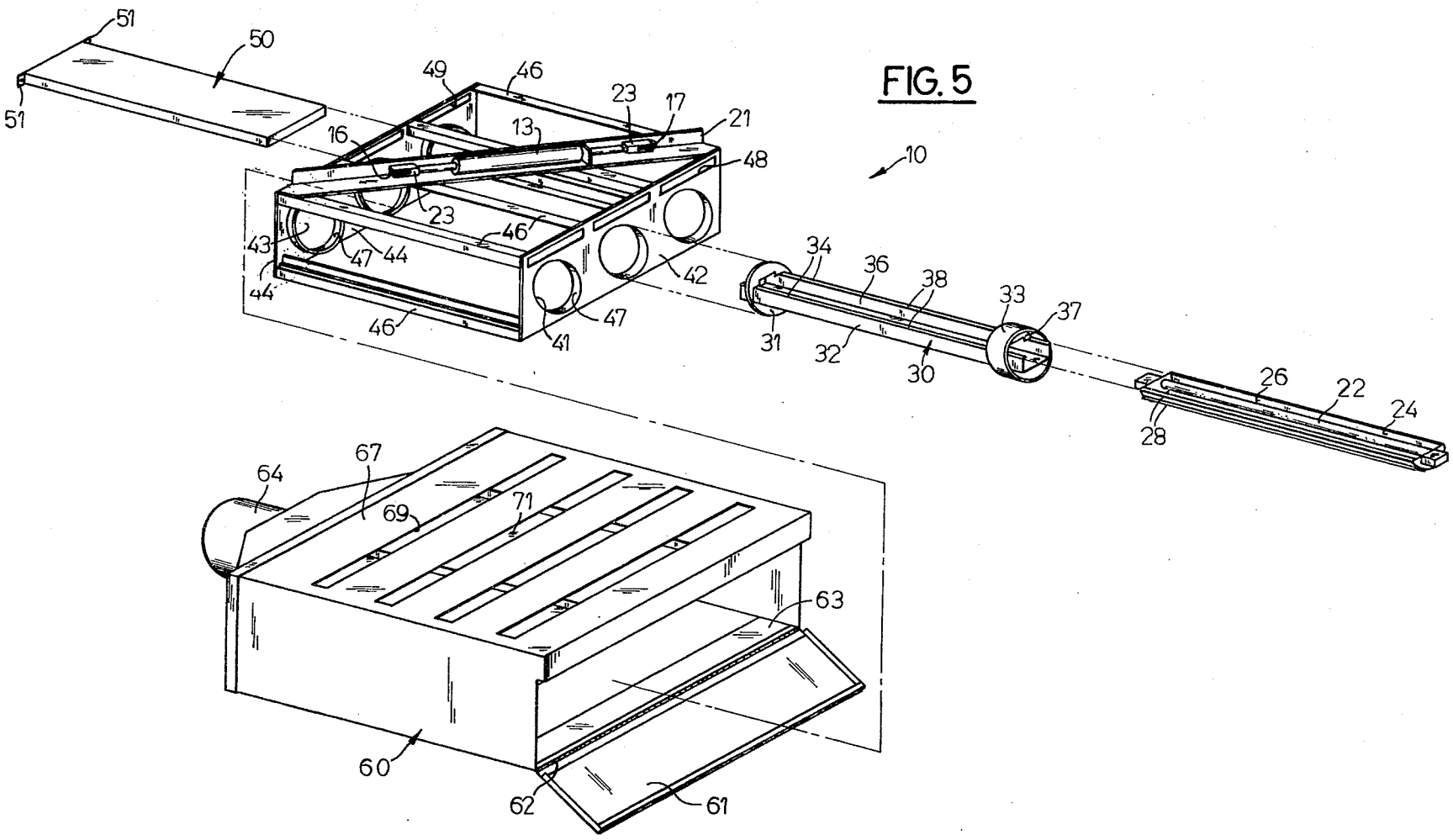
FIG. 5 is an exploded view of radiation assembly.
Figure 7:
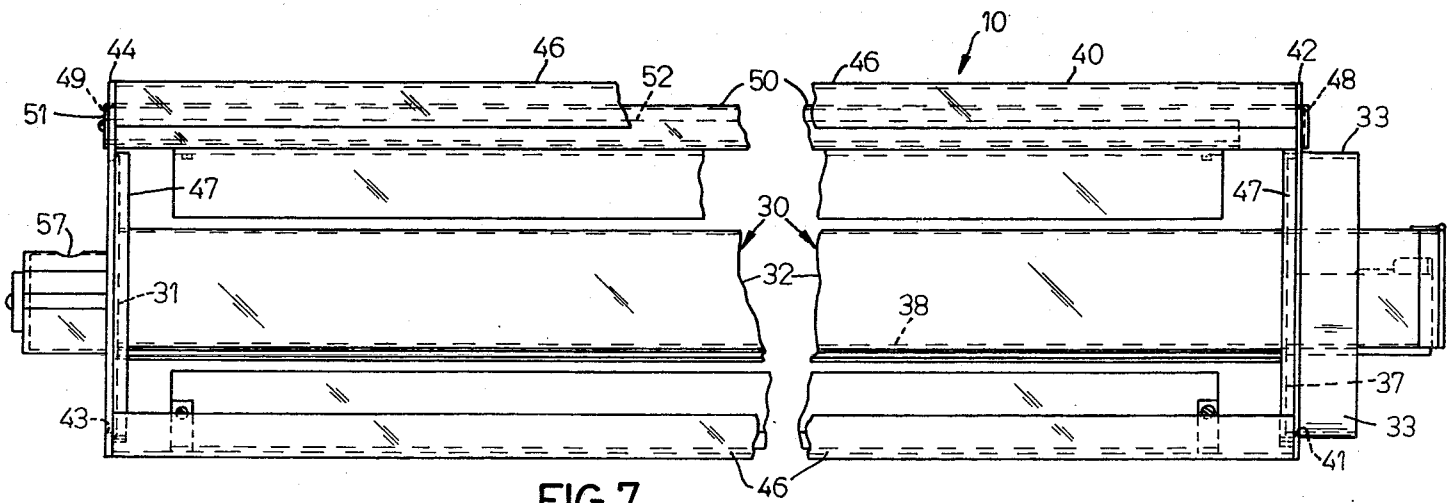
FIG. 7 is a cross-section view taken along the line 7—7 in FIG. 1.

FIG. 5 is an exploded view of the radiating assembly 10 and particularly illustrates the manner in which the component parts of the assembly interengage. The lamp assemblies 12 are each comprised of elongated ultraviolet mercury quartz lamps 22 which are received within an elongated reflector 24. The inside surface 26 of the reflector 24 is highly polished and is constructed of a material such as Alzak or Lurium which is not subject to oxidation even under high heats and in the presence of a corrosive atmosphere such as ozone. The inside surface of the reflector 24 has a generally elliptically shaped cross-section such that it will focus the light emitted by the lamp to form a band the length of the lamp and on the order of ½ inch wide.

Figure 4:
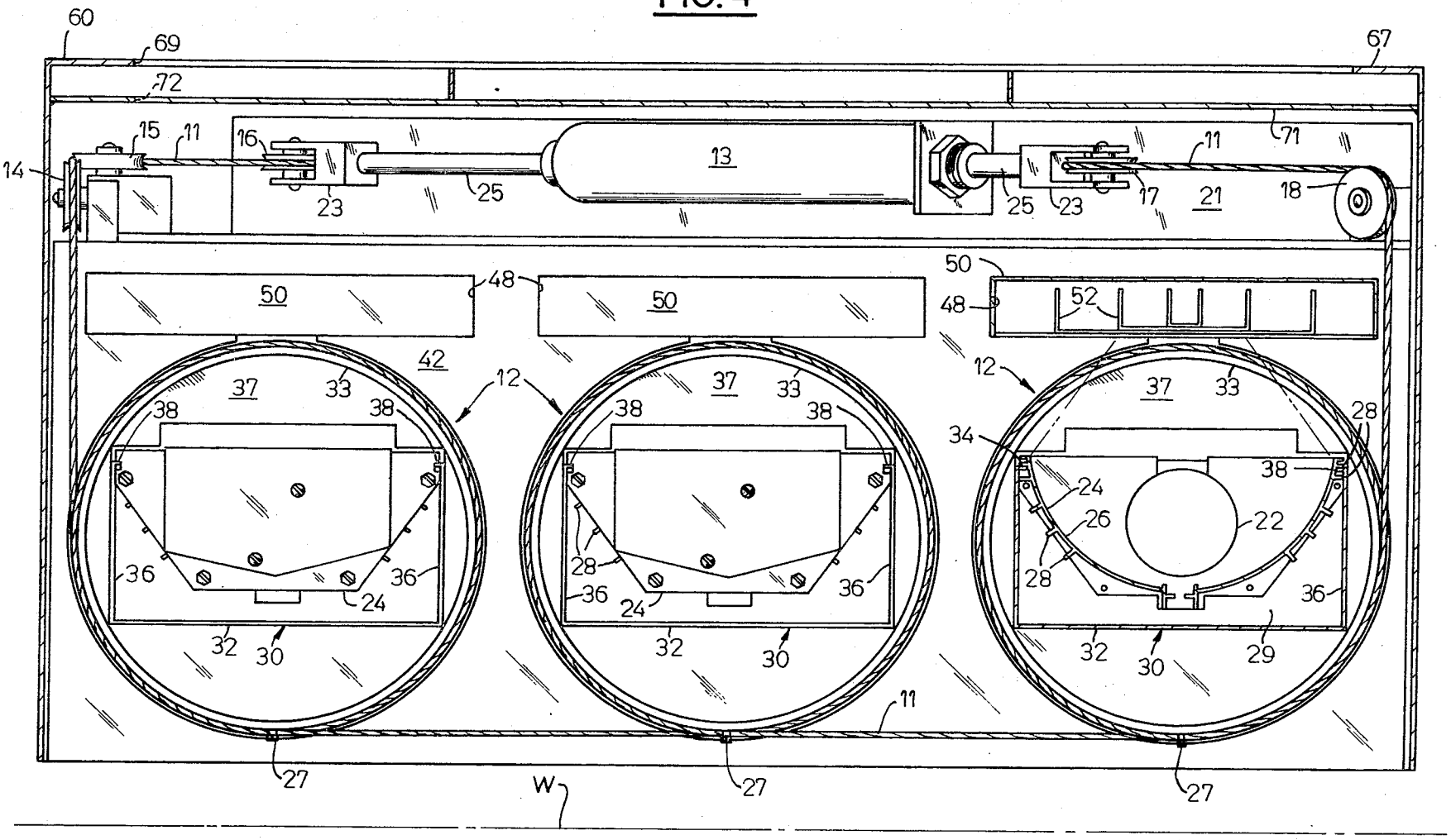
FIG. 4 is a view similar to FIG. 3 but showing the radiation assembly directing radiation away from the substrate.

The reflector 24 and lamps 22 are each supported by a reflector carrier 30 which slideably receives the edges of the reflector as best shown in the partial cross-section views in FIGS. 3 and 4. The reflector carrier 30 includes a generally elongated frame 32 having a rectangular cross-section and being open along the top. The top edges 34 of the side walls 36 of the frame 32 each include a lip 38 which is folded over and which serves to support the reflector 24 thereon. The reflector includes a plurality of cooling fins 28 projecting outwardly from its outer surface and extending its complete length. The reflector can thus be axially slideably received in the reflector carrier 30 with fins 28 of the reflector disposed above and below the lips 38 such that the reflector is suspended from the lips 38 by the fins 28. The reflector 24 and frame 32 define an air space 29 therebetween housing the reflector fins. Passage of air through this air space cools the reflector as will be described later. The reflector carrier 30 includes a circular ring 33 secured to the periphery of a disc 37 which is in turn secured to the other end of the frame 32 in the same manner that disc 31 is secured.

Figure 8:
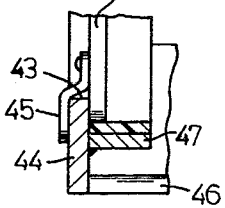
FIG. 8 is an enlarged partial view of the end of a lamp assembly received in and supported by a collar portion of the module.

Just as the reflector 24 is axially slideable into the reflector carrier 30, a plurality of lamp assemblies 12, each comprised of a reflector carrier 30, a UV lamp and a reflector, are axially slideable into the lamp module 40. The lamp module 40 comprises a pair of end plates 42 and 44 joined by a plurality of structural frame members 46. The end plates 42 and 44 are provided with a plurality of circular openings 41 and 43 respectively. The openings 41 in end plate 42 are each aligned with openings 43 in end plate 44 such that they can receive opposite ends of the reflector carriers 30. Collars 47 are secured to the inside surfaces of the end plates 42 and 44 around the circular openings 41 and 43 and are provided to support the circular disc 31 and the circular rings 33. The collars are lined with a coating of Teflon on their inside surface to facilitate rotation of the reflector carrier. After the lamp assemblies 12 have been slid into the module they may be held therein as shown in FIG. 8, by a clip 45 which is screwed to the disc 31 and which abuts the outside surface of wall 44. Each of the openings 41 and 43 are of an inside diameter which is on the order of ⅛ inch larger than the outside diameter of the disc 31 and ring 33 to further permit free rotation of the lamp assemblies 12 even if the heat generated by the lamps results in substantial expansion or deformation of the various parts.

The end plates 42 and 44 also include a plurality of aligned rectangular slots 48 and 49 spaced above the circular openings 41 and 43 for receiving and supporting heat exchangers 50 therein. The heat exchangers 50 are generally flat rectangular metal frames which can slide axially through the slots 49 to be supported at their other end by the slots 48. They include a pair of projecting tabs 51 at one end which permit them to be secured to end plate 44 by screws. FIGS. 3 and 4 each show cross-section views of the heat exchangers 50 and illustrate the vertically extending heat exchange fins 52. The purpose of the heat exchange fins 52 is to permit a maximum amount of heat to be removed from the module by air forced through the heat exchangers. To permit air to be forced through the heat exchanger 50, it includes as best shown in FIG. 6, an opening 53 in its lower surface adjacent the end received by the end plate 42 of module and an opening 54 at its other end for exit of air conducted through the heat exchanger.

The lamp module 40, including the heat exchangers 50 and the lamp assemblies 12 comprise of the reflector carriers 30 containing the UV lamps therein, is slideably received and supported within a housing 60. The housing 60 includes a door 61 which is hingeably connected along its lower edge by a piano hinge 62 to the lower frame portion 63 of the housing. FIG. 6 illustrates in cross-section the arrangement of the lamp module 40, lamp assemblies 12, and the heat exchangers 50 within the housing 60. The housing 60 includes an exhaust chamber 64 connected to its back wall 66, which chamber 64 can be attached to a fan (not shown) to permit air to be pulled through the housing to cool the component parts of the radiating assemblies. In order to permit air to flow into the housing 60, the upper wall 67 includes a plurality of transversly extending slits 69. It is also desired to prevent the escape of UV light through the slits 69 so a second wall 71 is provided adjacent to the upper wall 67 and including slits 72 which are out of alignment with the slits 69. Except for the slits 69 in its upper surface the housing comprises a generally air tight chamber such that the air flow through the housing and around lamp 22 can be controlled.

Figure 6:
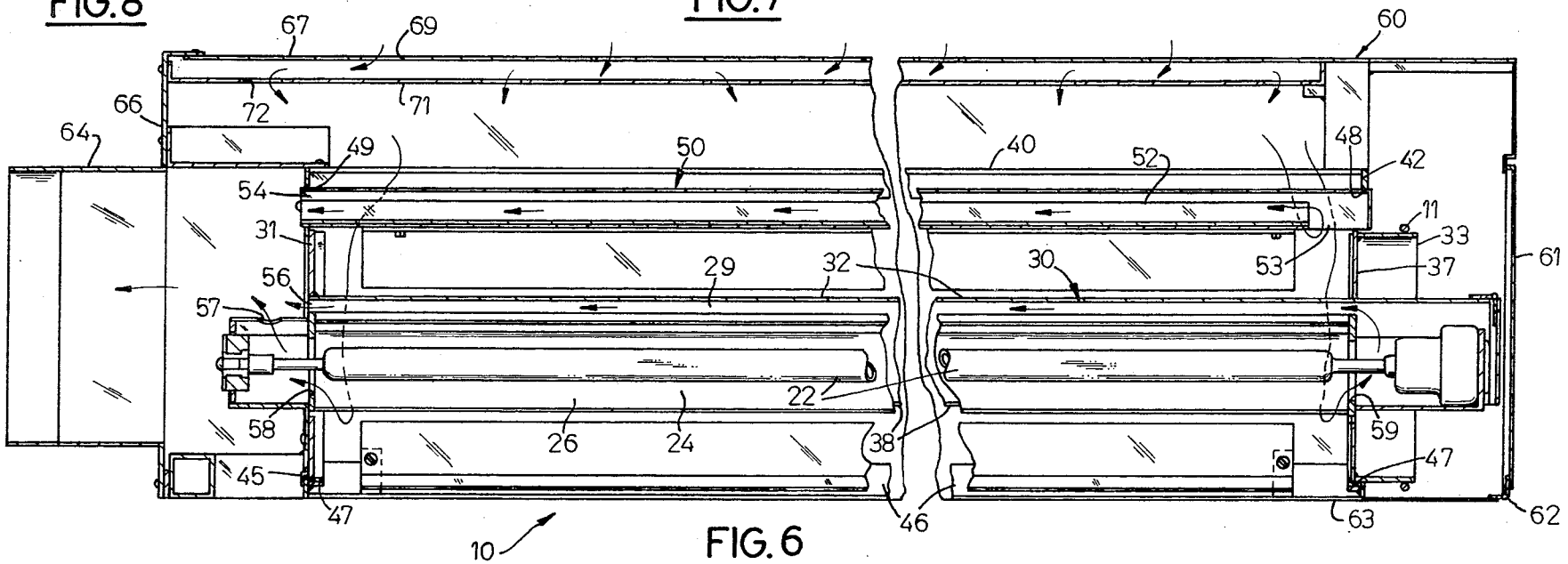
FIG. 6 is a cross-section view taken along the line 6—6 in FIG. 1.
Figure 10:
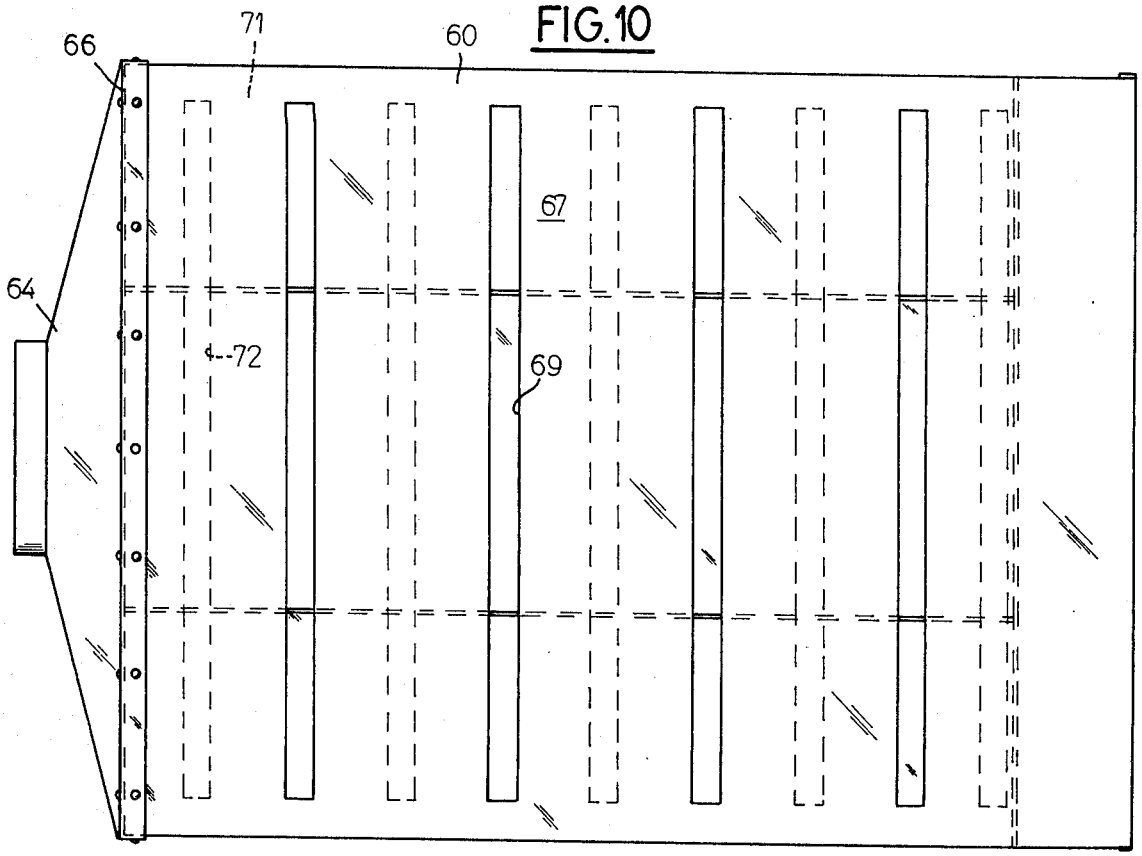
FIG. 10 is a plan view taken along line 10—10 in FIG. 3.

When the lamp assemblies 12 are positioned for radiating against the web W, as shown in FIG. 6, the air flows down through slits 69 and 72 and then between the frame members 46 in the upper surface of the module 40 and around the heat exchangers 50. The air exhausted through the sleeve 64 is either pulled through the opening 54 of the heat exchanger, through the gap 56 existing between the backside of the reflector 24 and bottom of the frame 32, or through the holes 57 in the end of the reflector. In order for the cooling air to escape through the gap 56 or the holes 57 it must pass around the outside of the reflector carrier 30 and then up into the reflector 24 and through the bores 58 and 59 housing the ends of the lamps. The air passing through the bore 59 surrounding the right end of the lamp shown in FIG. 6, then flows through air space 29 between the backside of the reflector 24 and the frame 32 until it exits through the gap 56 into the chamber 64. This air flow cools the end of the lamp opposite exhaust chamber 64 and cools the entire length of the reflector 24. Air also flows through the bore 58 at the left end of the lamp assembly cooling that end of the lamp and exits through a hole 57 to the exhaust chamber 64.

The air flow around the ends of the lamps in the manner stated is particularly important because the heat emitted by the lamps can damage the ends of the lamps if they are not sufficiently cooled, but on the other hand, it is desirable that the light emitting portion of the lamp 22 not be cooled because cooling decreases the efficiency of the lamp. The apparatus of the invention results in substantial air flow around the end of the lamps and across the back of the reflector but relatively little air flow around the central portion of the lamp.

When the web W has been halted and the lamp assemblies 12 are rotated into the position shown in FIG. 4, the air flow through the housing is substantially the same as that previously described. When the lamp assemblies are in this position, the power to the lamps is decreased by 50%. Despite this power decrease, the lamps still radiate a substantial quantity of heat. However, this heat is directed against the lower surface of the heat exchanger 50 which is capable of dissipating it through the fins 52 into the air being pulled through the heat exchanger. The open end 54 of the heat exchanger communicates with the chamber 64 and the opening 53 in the bottom wall at the other end permits air flow through the heat exchanger 50 and along the fins 52. The air flow around the ends of lamps 22 and through the bores 56 in the discs 31 and 37 is substantially the same as when the lamp assemblies 12 are directed at the web W except that the air flows downwardly directly into the bores 56 rather downwardly around the back of the assembly and then upwardly through the bores.

FIGS. 11–16 illustrate a second embodiment of the present invention wherein means are provided to focus a pair of lamp assemblies 12' on the same surface portion of the web W' simultaneously. The purpose of focusing two lamps on the same area of the web W' arises from a two-fold problem. It has been found that non-solvent ink may be more efficiently cured by subjecting it to high ultraviolet light intensity for a brief period of time rather than subjecting it to a moderate light intensity for an extended period of time. Experimentation shows that if the UV light intensity striking the web is too low, even continued exposure of the non-solvent ink will have little curing effect and in fact only the outer surface of the ink may cure. On the other hand, if the intensity of the light is sufficiently high, even a brief exposure will result in complete curing of the ink. It has also been found that when the web is conveyed past the lamps at high rates of speed, i.e., in excess of 500 feet per minute, the ink does not cure evenly leaving uncured bands of ink across the width of the web W'. The ultraviolet lamp which are commercially available emit UV light varying in intensity from zero to a maximum value at a frequency of approximately 120Hz when operated at 60Hz line frequency. Since the lamps are focused on an area only one half inch wide for only a brief period of time as the web passes beneath the lamps, and because the intensity of the light emitted from the lamps varies from a maximum value to zero during each cycle, when the web passes beneath the lamps at high speed, those portions of the web which pass under the lamps when the intensity is near zero do not receive sufficient radiation for a sufficient length of time for the ink thereon to cure. The result is a web having stripes or bands of uncured ink across its width. Previous attempts to deal with this problem have employed the use of a large number of lamps in series, the assumption being that at least one of the lamps would radiate enough light against the web to cure the ink. Such attempts were wasteful of power required to operate unnecessary lamps, subjected the web to unnecessarily prolonged heat and were not consistently effective to completely cure the ink.

Figures 16A, 16B, 16C:
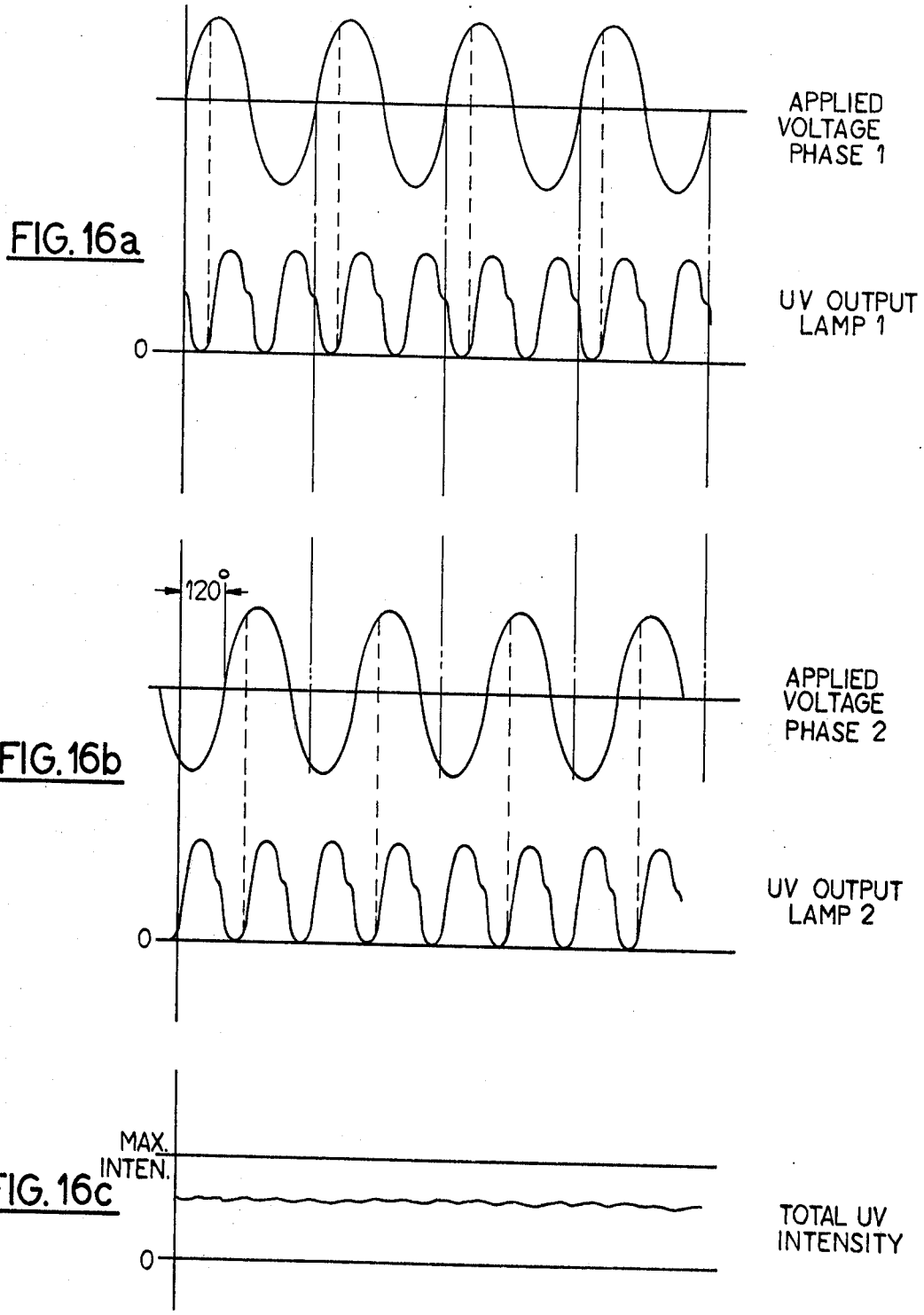
FIG. 16*a*–16*c* are schematic illustrations of the relationship between the ultraviolet light output of a pair of lamps in response to the voltage applied thereto and the combined intensity of the emitted ultraviolet light when focused on the same area.

The embodiment of the invention, shown in FIGS. 11–15 is a substantial improvement over the prior art in that it provides a pair of lamps having their light focused on the same area of the web thereby increasing the average intensity of the light directed at the web such that the non-solvent ink is subject to a high intensity UV light for a short period of time rather than a relatively low intensity light for a longer period of time. Furthermore, voltage is applied to the lamps so that the lamps are out of phase by 120°whereby the combined intensity of light emitted by the lamps can be maintained at a relatively constant value despite variations of the intensity of light emitted by the lamps individually. The curves shown in FIG. 16 best illustrate the improved results achieved by using a plurality of focused lamps which are operated out of phase with each other. FIG. **16*a* shows an upper curve illustrating voltage input to a UV lamp with respect to time and a lower curve illustrating the UV light ouput of that lamp in response to the voltage input. FIG. 16*b* shows similar voltage and light output curves for a second lamp, with the second lamp being 120° out of phase with first. FIG. 16*c*** shows the resulting curve indicating the combined intensity of UV light emitted by the two lamps when focused on the same area. It is readily apparent from these curves that focusing a plurality of lamps, operated out of phase with each other yields a relatively constant UV radiation rather that the cyclical intensity resulting from the use of a single lamp.

Figure 11:
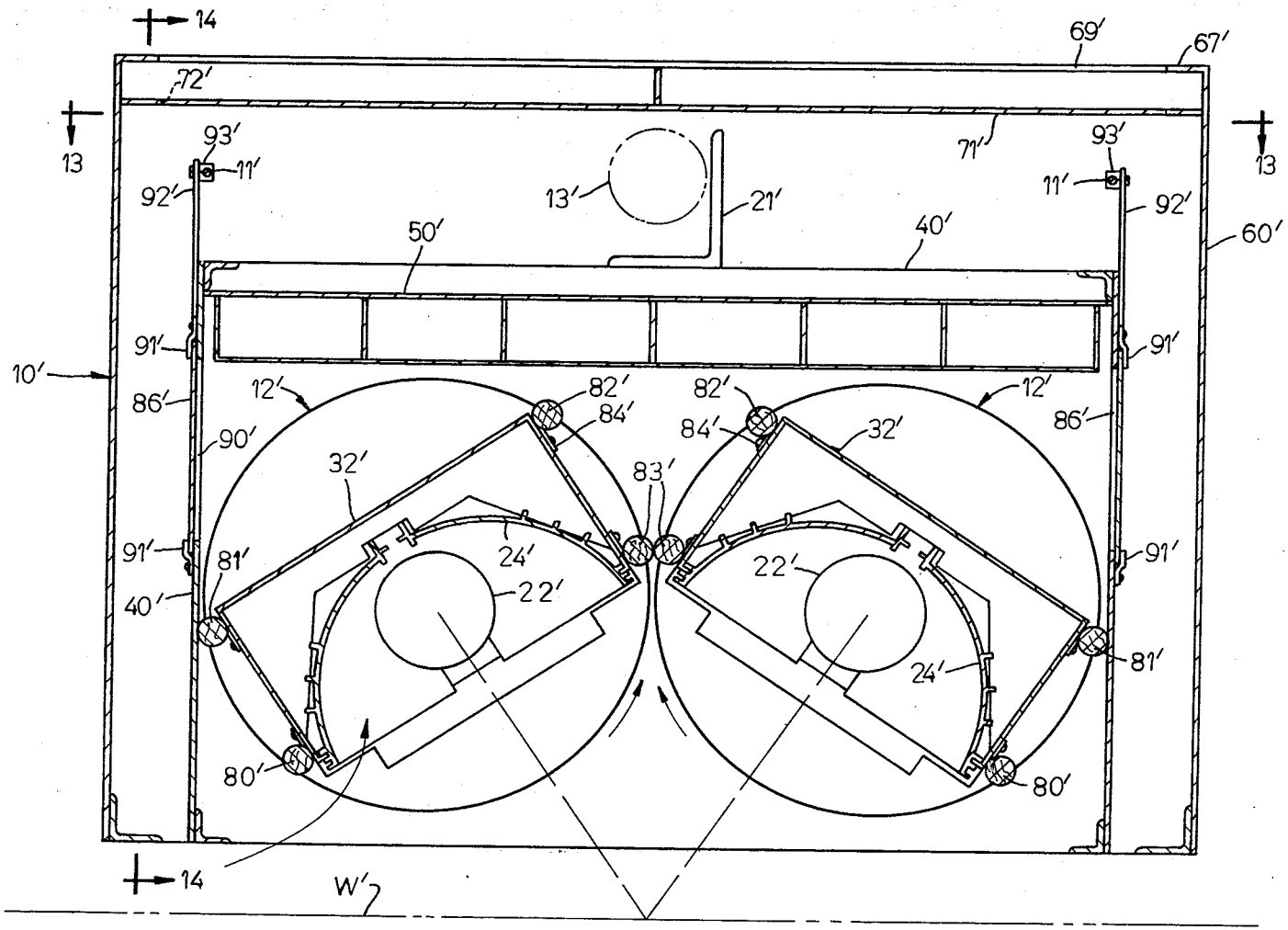
FIG. 11 is a view similar to FIG. 3 but showing a second embodiment of the invention wherein ultraviolet light is focused by a pair of ultraviolet lamps on a particular area of a substrate.

As shown in FIG. 11 the ultraviolet radiation assembly 10' of the present invention includes a pair of lamp assemblies 12' which are directed at the web W' such that the UV light emitted from each is focused on the same area of the web W'. The lamps are connected to a power source in such a manner that the voltage applied to one lamp is 120° out of phase with that applied to the other. As previously explained, light focused on the web W' will be increased in intensity because both of the lights are focused on it and the light intensity will not fluctuate substantially due to the frequency of operation of the lamps because the frequencies of the lamps are not in phase. The radiation assemblies 10' are in most other respects substantially similar to the assemblies 10' described with respect to the embodiment of the invention shown in FIGS. 1–8 except for the variations described hereafter. Elements common to both embodiments are similarly numbered.

Figure 12:
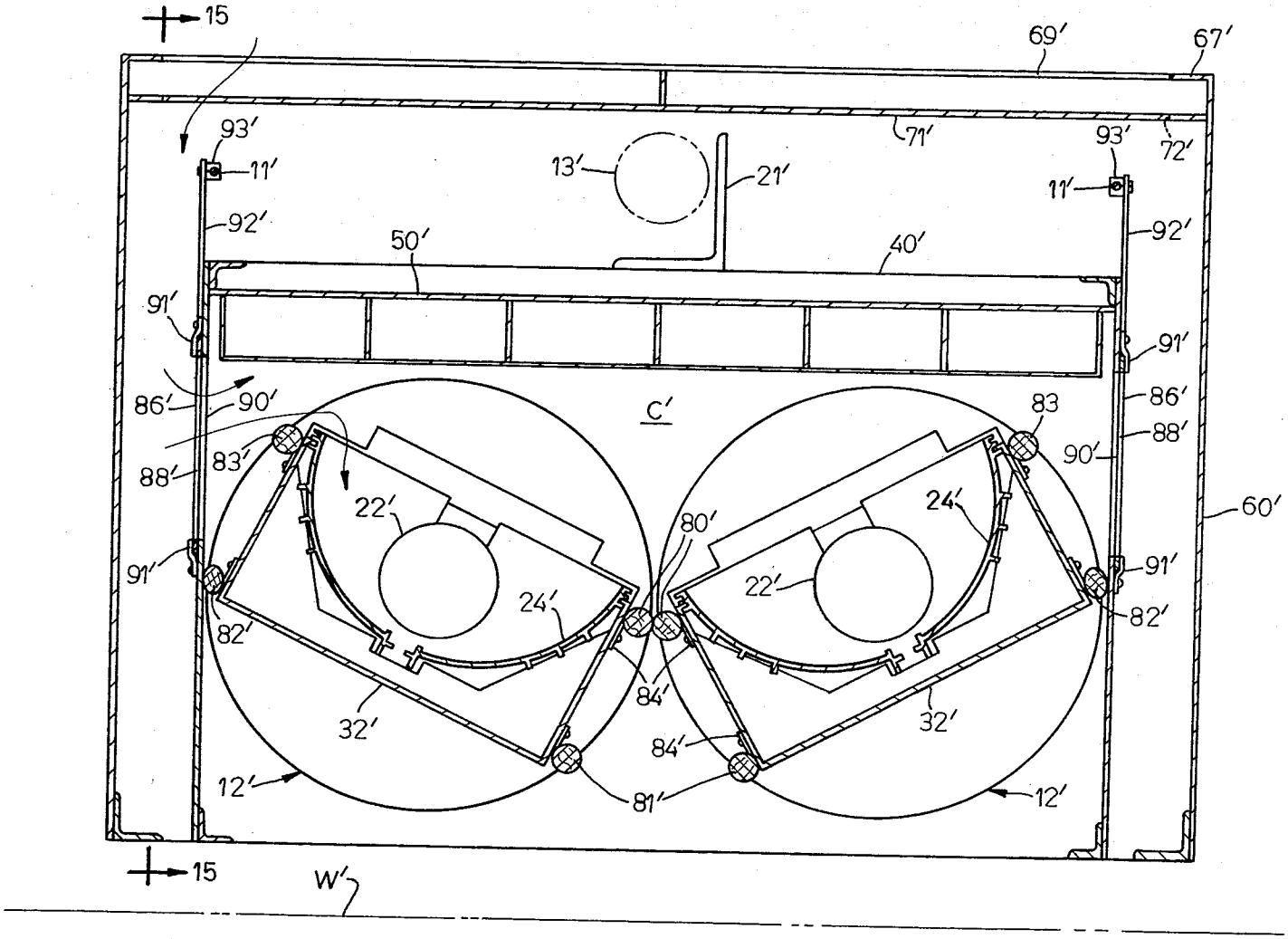
FIG. 12 is a view similar to FIG. 11 but showing the ultraviolet lamps directed away from the substrate.

Referring to FIGS. 11–13, the lamp assemblies 12' are rotated by a cable 11' which is wound around the rings 33' of the assemblies and connected by means of the sheaves 14'–19' to opposite ends of a piston rod 25' of a fluid actuated cylinder 13'. The cable 11' is secured to the rings 33' by screws 27' such that activation of piston rod 25' when the lamp assemblies 12' are in the position wherein they point at the web, results in rotation of the lamp assemblies about their axis so that they direct radiation toward each other and then toward the heat exchanger 50' as shown in FIG. 12. Movement of the rod 25' in the opposite direction causes the lamp assemblies 12' to rotate from the position shown in FIG. 12 toward each other and then to a position wherein they direct radiation toward the web as shown in FIG. 11.

The lamp assemblies 12' each include four elongated seals 80'–83' secured to the sides of the frame members 32' for preventing leakage of UV radiation around the lamp assemblies when the lamps are directed upwardly toward the heat exchanger 50' as shown in FIG. 12. The use of the seals 80'–83' is useful for example to permit the operator of the apparatus to lift the radiation assembly 10' away from the web and to adjust the web W' without being exposed to the UV light. The seals also function to prevent air flow between the lamp assemblies and between the lamp assemblies and the side walls of the module thus maximizing the flow of air around the ends of the lamp for cooling them as will be described hereafter. The seals 80'–83' can be, for purposes of example, comprised of asbestos material wound around asbestos rope and secured to a metal strap 84' which is riveted to the outside surfaces of the frame 32' to secure the seals thereto. The seals are generally resilient so that when the lamp assemblies 12' rotate, the seals 80' can be compressed against the wall of the module 40', and the seals 83' can be compressed in mating engagement to prevent escape of light between them. The seals are comprised of asbestos fibers in the embodiment illustrated because of its resistance to heat but other materials which have sufficient heat resistance qualities are also within the scope of the invention. Similarly, other means may be employed to attach the seals to the sides of the lamp assemblies.

The embodiment of the invention shown in FIGS. 11–15 also includes means to advantageously control the flow of cooling air through the radiating assembly 10' and to minimize the size of the exhaust fan required by preventing the flow of air through the heat exchanger 50' except when the lamp assemblies 12' have been rotated to radiate toward the heat exchanger. To prevent air flow into the heat exchanger, the module 40', the heat exchanger 50' and the lamp assemblies 12' form a closed chamber C' with the asbestos seals 80'–83' functioning to maintain a generally air tight seal between the respective lamp assemblies and the side walls of the module. Air may be permitted to flow into the chamber C' only through a plurality of openings 90' formed in the sides of the module 40'. The openings 90' are covered by slideable dampers 86' which include a plurality of openings 88'. The openings 88′ can be aligned with the openings 90′ of the module to permit air to be drawn into the chamber C′ and through the heat exchanger 50′ or slideably closed to prevent the flow of air through the openings 90′. The slideable dampers 86′ are mounted in tracks 91′ and are operatively connected to the cables 11′ by upwardly extending projections 92′ and by clips 93′. Each of the clips 93′ is rigidly secured to the cable 11′ such that movement of the cable 11′ not only causes rotation of the lamp assemblies 12′ but also causes complementary sliding movement of the dampers 86′ to align the openings 88′ with the openings 90′ in the sides of the module. When the lamp assemblies 12′ are in the position for directing radiation toward the web W′, the dampers 86′ will be maintained in a position as shown in FIG. 14 wherein the openings 88′ of the dampers are out of alignment with respect to the openings 90′. Air flow into the chamber C′ and the heat exchanger is thus prevented. If however, the lamp assemblies 12′ are rotated such that they are directed toward the heat exchanger 50′, movement of the cables 11′ thus causes sliding movement of the dampers 85′ in the tracks 91′ and alignment of the openings 88′ with the openings 90′. Air flow will thus be permitted through the openings 90′ and through the heat exchanger 50′.

I claim:

1. Ultraviolet radiating means for curing and drying a substrate comprising: a housing means, a plurality of ultraviolet elongated lamp assemblies each having a longitudinal axis and supported in parallel relation in said housing for selectively radiating ultraviolet radiation against said substrate, an elongated heat exchanger supported in said housing and adjacent said lamp assemblies, said housing including means for supporting each of said lamp assemblies for rotation about its longitudinal axis from a drying position wherein said lamps direct radiation to said substrate to a heat exchange position wherein said lamp assemblies direct radiation to said heat exchange assemblies, and means for simultaneously rotating each of said lamp assemblies including a flexible member wound around each of said lamp assemblies and secured to each of said lamp assemblies and a fluid motor supported by said housing, said fluid motor including a reciprocable member having opposite ends, said flexible member having opposite ends, one of said opposite ends of said flexible member being attached to an end of said reciprocable member for movement therewith and the other of said opposite ends of said flexible member being attached to the other end of said reciprocable member for movement therewith whereby activation of said fluid motor causes said flexible member to simultaneously rotate said lamp assemblies.

2. The ultraviolet radiating means set forth in claim 1 wherein said lamp assemblies each include an elongated generally cylindrical ultraviolet lamp, an elongated reflector positioned around a portion of said lamp for directing ultraviolet radiation, and a reflector carriage supporting said lamp and reflector and having circular ends and wherein said housing receives said circular ends of said reflector carriages whereby said lamp assemblies may be axially inserted into said aligned bores and rotatable therein.

3. The ultraviolet radiating means as set forth in claim 1 wherein said housing includes a plurality of first air passages, and wherein said heat exchange means includes a plurality of metal fins defining a plurality of second air passages, said first and second air passages being in communication whereby air may be forced through said housing and heat exchanger for cooling said lamp assemblies.

4. Ultraviolet radiating means for curing and drying a substrate comprising: a housing means, an elongated ultraviolet lamp assembly means for selectively radiating ultraviolet radiation against said substrate, said lamp assembly means including a longitudinal axis, a lamp assembly module, said housing including a chamber therein for receiving said lamp assembly module and including means for supporting said lamp assembly module for slideable movement into and out of said chamber, said lamp assembly module including means for supporting said elongated ultraviolet lamp assembly means for axial slideable movement into and out of said module and for rotation about said axis, and heat exchange means positioned in said module and supported thereby adjacent to said lamp assembly means, said lamp assembly means being rotatable in said module from a drying position wherein said lamp assembly means directs radiation to said substrate to a heat exchange position wherein said lamp assembly means direct radiation to said heat exchange means, and means for rotating said lamp assembly means in said modules from a drying position to a heat exchange position.

5. The ultraviolet radiating means set forth in claim 4 wherein said lamp assembly means includes an elongated generally cylindrical ultraviolet lamp, an elongated reflector positioned around a portion of said lamp for directing ultraviolet radiation, and a reflector carriage supporting said lamp and reflector and having circular ends, and wherein said means for supporting said elongated ultraviolet lamp assembly means includes a pair of spaced apart parallel walls each of said walls including a circular bore therein, the circular bores of said walls being aligned for receiving said circular ends of said reflector carriages whereby said lamp assembly means may be axially inserted into said aligned bores to be rotatable therein and supported in parallel relation.

6. The ultraviolet radiating means set forth in claim 5 wherein said reflector carriage includes means for slideably supporting said elongated lamp and said elongated reflector in releasably secured relation therein, and for slideable movement parallel to said axis of rotation.

7. The ultraviolet radiating means set forth in claim 4 wherein said housing includes a hinged door in one end for permitting removal of said module therefrom.

8. Ultraviolet radiating means for curing and drying a substrate comprising: a housing means, a plurality of ultraviolet lamp assemblies for selectively radiating ultraviolet radiation against said substrate, a lamp assembly module, said housing including a chamber therein for receiving said lamp assembly module and including means for supporting said lamp assembly module for slideable movement into and out of said chamber, said lamp assembly module including means for supporting said elongated ultraviolet lamp assemblies in parallel side-by-side relation and for axial slideable movement into and out of said module, and heat exchange means positioned in said module and adjacent said lamp assemblies, said lamp assemblies being rotatable in said module from a drying position wherein said lamps direct radiation to said substrate to a heat exchange position wherein said lamp assemblies direct radiation to said heat exchange assemblies, and means for simultaneously rotating each of said lamp assemblies in said modules from a drying position to a heat exchange position, said means including a drive means and a flexible member operably connected to said drive means and wound around each of said lamp assemblies.

9. The ultraviolet radiating means set forth in claim 8 wherin said lamp assemblies each include an elongated generally cylindrical ultraviolet lamp, an elongated reflector positioned around a portion of said lamp for directing ultraviolet radiation, and a reflector carriage supporting said lamp and reflector and having circular ends, and wherein said module includes a plurality of pairs of aligned bores, each of said pairs of aligned bores for receiving said circular ends of a reflector carriage of one of said lamp assemblies whereby each of said lamp assemblies may be axially slideably inserted into said aligned bores and rotatable therein.

10. The ultraviolet radiating means as set forth in claim 9 wherein said flexible member is a drive cable and said drive means includes a fluid pressure cylinder having a reciprocable piston, and wherein said drive cable is wound around the circumference of one of said circular ends of each of said lamp assemblies and is secured thereto, said cable being operably connected at each of its ends to said piston whereby actuation of said piston causes said lamp assemblies to rotate simultaneously.

11. The ultraviolet radiating means as set forth in claim 8 wherein said housing includes a plurality of air passages, and wherein said heat exchange means includes a plurality of air passages therethrough and a plurality of metal fins defining said passages, said air passages being in communication whereby air may be forced through said housing and heat exchanger for cooling said lamp assemblies.

12. The ultraviolet radiating means as set forth in claim 9 wherein said housing, said module, and said lamp assemblies include a plurality of first air passages, and wherein said heat exchange means includes a plurality of second air passages therethrough and a plurality of metal fins defining said passages, said first and second air passages being in communication whereby air may be forced through said housing and heat exchanger for cooling said lamp assemblies.

13. Ultraviolet radiating means for curing and drying nonsolvent ink received on a surface of a substrate comprising: a plurality of ultraviolet lamp assemblies for selectively focusing and radiating ultraviolet radiation against a portion of said substrate, a support means for rotatably supporting a plurality of said lamp assemblies in parallel relation, said lamp assemblies being supported such that at least two of said assemblies focus radiation on the same portion of said surface of said substrate, heat exchange means supported by said support means adjacent to said lamp assemblies, said lamp assemblies being rotatable from a drying position wherein said lamp assemblies direct radiation to said substrate to a heat exchange position wherein said lamp assemblies direct radiation to said heat exchange means, and means for simultaneously rotating said lamp assemblies, said last stated means including a drive means and a flexible member operably connected to said drive means and wound around each of said lamp assemblies.

14. The ultraviolet radiating means set forth in claim 13 wherein said lamp assemblies each include an elongated generally cylindrical ultraviolet lamp, an elongated reflector positioned around a portion of said lamp for directing ultraviolet radiation, and a reflector carriage supporting said lamp and reflector and having circular ends, and wherein said module includes aligned bores for receiving said circular ends of said reflector carriages whereby said lamp assemblies may be axially slideably inserted into said aligned bores and rotatable therein, and said reflector carriage includes a plurality of elongated resilient seals secured thereto and forming seals between said lamp assemblies and between said lamp assemblies and said module.

15. The ultraviolet radiating means set forth in claim 13 wherein each of said housing, module and heat exchanger means includes air passages therethrough, said air passages being in communication whereby air may flow through said housing, module and heat exchanger for cooling, and further including damper means slideably mounted on said module and operably connected to said flexible member, said damper means being operable to selectively prevent air flow through said module and said heat exchanger.

16. The ultraviolet radiating means set forth in claim 13 wherein said ultraviolet lamp assemblies are connected to alternating current power source means whereby voltage is applied to each of said lamp assemblies in an out-of-phase relation and whereby the radiation emitted from said lamp assemblies is out-of-phase such that the combined intensity of radiation emitted by said assemblies can be maintained at a relatively constant value.

* * * * *